US006860475B2

(12) United States Patent
Wong

(10) Patent No.: US 6,860,475 B2
(45) Date of Patent: Mar. 1, 2005

(54) ANGLE CLAMP WITH Z-AXIS ATTACHMENT AND QUICK ACTING BUTTONS

(75) Inventor: Harry Wong, South Pasadena, CA (US)

(73) Assignee: Valtra, Inc., Pico Rivera, CA (US)

( * ) Notice: Subject to any disclaimer, the term of this patent is extended or adjusted under 35 U.S.C. 154(b) by 0 days.

(21) Appl. No.: 10/610,688

(22) Filed: Jul. 1, 2003

(65) Prior Publication Data

US 2004/0007803 A1 Jan. 15, 2004

Related U.S. Application Data

(60) Provisional application No. 60/393,874, filed on Jul. 8, 2002.

(51) Int. Cl.[7] ..... B25B 1/20
(52) U.S. Cl. ..... 269/41; 269/43; 269/44
(58) Field of Search ..... 269/41, 43, 71–73, 269/60, 152, 154, 44

(56) References Cited

U.S. PATENT DOCUMENTS 6,254,075 B1 * 7/2001 Kozima ..... 269/73
6,491,294 B1 * 12/2002 Hyatt ..... 269/41
6,648,318 B1 * 11/2003 Oetlinger et al. ..... 269/41
2004/0007803 A1 * 1/2004 Wong ..... 269/41

* cited by examiner

*Primary Examiner*—Lee D. Wilson

(57) ABSTRACT

A clamping device allows welding, or other application of three-axis workpieces by providing X, Y, and Z clamping surfaces. The device is equipped with three mutually perpendicular base plates and on one of which a floating right-angle head is mounted through a threaded shaft with quick acting button for rapid advance and return. Inserts like leveling pads can be inserted to the tooling holes in the floating right-angle head to increase working access, especially at the joint area where the X and Y axes meet. A Z-axis attachment including base plate extension with clamping arm and a threaded shaft is mounted by screws to two of the base plates. The clamping arm of the Z-axis can be swung away for easy removal of the workpiece after work. The outside walls of the base plates are machined flat and square so that the angle clamp can be laid sideway to hold a workpiece vertically in place.

9 Claims, 6 Drawing Sheets

ANGLE CLAMP WITH Z-AXIS ATTACHMENT AND QUICK ACTING BUTTONS

Note: This application is based on my provisional patent application filed on Jul. 8, 2002 with application Ser. No. 60/393,874.

REFERENCE

U.S. PATENT DOCUMENTS

U.S. Pat. No. 788,716 filed May 1905 R. A. Hammond & F. E. Walden

U.S. Pat. No. 2,430,458 filed November 1947 Leo E. Farrell

U.S. Pat. No. 3,492,886 filed February 1970 E. M. Naureckas

U.S. Pat. No. 4,789,146 filed December 1988 Andrew Kuei

U.S. Pat. No. 5,897,109 filed April 1999 Kuo-chuan Lin

BACKGROUND OF THE INVENTION

1. Field of the Invention

The present invention relates to an improved clamping device which can be used to hold workpieces in a three dimensional 90-degree relationship with the addition of the Z-axis attachment. And the workpieces can easily be removed after work by pressing the quick acting buttons to release the threaded shafts mounted with the clamping heads. The swing away clamping arm of the Z-axis attachment gives even more room for easier removal of the workpieces if necessary.

2. Description of the Related Art

A typical clamp (or vise) generally includes a fixed head (or jaw) and a movable head (or movable jaw) attached to one end of a threaded shaft. Clamping action is achieved by turning the threaded shaft so that the movable head is moved towards the fixed head against the workpiece. By turning the threaded shaft counterclockwise, the movable head is moved away from the fixed head and hence the workpiece is released. With such a device, a workpiece is clamped in one direction, or one dimensional. To clamp workpieces in two or three different directions, two or three such devices have to be used and fixed to a specially constructed fixture which provides the multi-dimensional relationship of the workpieces. However, the setup of this fixture is time-consuming and sometimes inconvenient.

Furthermore, the movable heads have to be moved in or out individually by turning the corresponding threaded shaft clockwise or counterclockwise to adjust for different sizes of workpieces. This is another time-consuming process.

The present invention is intended to simplify the procedures and minimize the time consumed in clamping the workpieces in a three-dimensional mutually perpendicular relationship and in releasing the assembled workpieces after work.

BRIEF SUMMARY OF THE INVENTION

An angle clamp in accordance with the present invention comprises three mutually perpendicular base plates, one square shape bottom-plate and two smaller rectangular side-plates. The bottom-plate includes two slotted holes along two adjacent edges which are not connected to the side-plates, one along each edge, so that the angle clamp can be fixed to a work desk with two screws. The bottom-plate is equipped with a protruded ear at the vertex away from the side-plates. The ear is positioned to face the opposite vertex. A quick release mechanism with quick acting button and half-threaded nut is mounted in the notch of the ear so that it is free to rotate about its vertical axis. A threaded shaft is inserted through the half-threaded nut in the direction of the diagonal of the bottom-plate. The threaded shaft can be swung horizontally with the half-threaded nut in various directions other than 45 degrees to the edges of the bottom-plate. Attached to the outside end of the threaded shaft is a handle for turning the threaded shaft inward or outward to clamp or release the workpieces. A right-angle head is mounted to the inside end of the threaded shaft through a pivoted block so that the right-angle head is free to swivel for an angle horizontally. Hence it is called the floating right-angle head. These features are designed to clamp workpieces of different sizes against the side-plates at a two dimensional 90-degree relationship (X and Y axes).

The floating right-angle head is equipped with two tooling holes, one on each clamping surface. Inserts like leveling pads can be inserted with adjustable protrusion so that the workpieces can be clamped with desirable working clearance from the floating right-angle head to make enough room for welding or other work process on the workpieces.

The outside walls of the two side-plates are machined flat and square so that the angle clamp can be laid sideway, or used in an upright position to hold a workpiece perpendicular to the surface of the work desk without the help of a fixture or mounting screws.

A Z-axis attachment can be mounted by screws to the two side-plates accurately and securely. This Z-axis attachment comprises two side-plate extensions joined at one side at 90-degree relationship, a swing away clamping arm with quick release mechanism at the free end, a threaded shaft fed through the quick release mechanism and a clamping head pivoted to the inner end of the threaded shaft. The threaded shaft is positioned along the same direction as the one mounted on the bottom-plate when the clamping arm is at its clamping position. By turning this threaded shaft inward, a third workpiece can be clamped against the corner of the two side-plate extensions of the Z-axis attachment at a position perpendicular to the bottom-plate. As a result, three workpieces can be clamped in three dimensional relationship along three mutually perpendicular directions (X, Y and Z axes) with the setup of one clamping device. In welding applications, the Z-axis attachment is also needed to hold the third welded part securely in place, and to counteract the contraction force induced by a cooling weld.

The assembled workpiece, which may be very bulky, can be removed easily with the clamping arm of the Z-axis attachment swung away to one side of the angle clamp.

The two quick release mechanisms, one mounted on the bottom-plate and the other mounted at the free end of the clamping arm of the Z-axis attachment, are provided for feeding the corresponding threaded shaft. Each quick release mechanism consists of a spring-loaded half-threaded nut connected to a quick acting button. When the quick acting button is pressed, the threaded surface of the half-threaded nut is pushed away from the surface of the threaded shaft. The threaded shaft, and hence the clamping head can be pushed in or pulled out rapidly through the nut with the desirable distance. The screwing action is resumed when the quick acting button is released.

DETAILED DESCRIPTION OF THE INVENTION

With the help of the drawings and the detail description below, the features of the present invention will be apparent and fully understandable.

Figure 1:
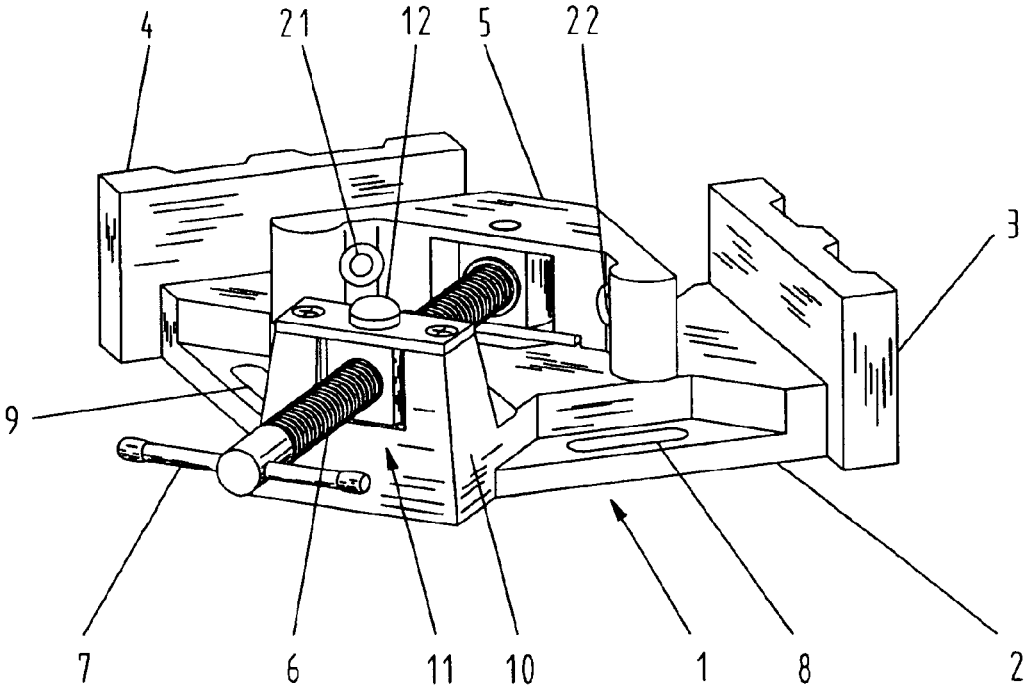
FIG. 1 is a perspective view of the angle clamp without the Z-axis attachment.

Referring to FIG. 1, the angle clamp 1 comprises three mutually perpendicular base plates, a square shape bottom-plate 2, two rectangular side-plates 3 and 4, and a floating right-angle head 5 attached to a threaded shaft 6 with handle 7. The two side-plates 3 and 4 are located at two adjacent edges of the square shape bottom-plate 2 so that both are perpendicular to the bottom-plate 2 and at right angle to each other. Two slotted holes 8 and 9 are provided along the other two adjacent edges of bottom-plate 2 for accepting screws to fix the angle clamp 1 to a work desk. At the vertex of these two adjacent edges, a vertical ear 10 is equipped at 135 degrees to these edges for feeding the threaded shaft 6. Threaded shaft 6 is fed through a quick release mechanism 11 pivoted at the upper center of ear 10 in a normal direction at 45 degrees to the edges and pointing to the opposite vertex of the bottom-plate 2. The threaded shaft 6 can be swung horizontally with the quick release mechanism 11 at a certain angle away from the normal 45-degree direction for better clamping of workpieces of different shape and sizes. Floating right-angle head 5 is pivoted to the inner end of the threaded shaft 6 and rests on the flat surface of the bottom-plate 2. Floating right-angle head 5 is free to swivel horizontally and to slide on the flat surface of bottom-plate 2 for better clamping of workpieces. Two workpieces can be clamped at right-angle to each other between the right-angle head 5 and the inside surfaces of the two side-plates 3 and 4 along two mutually perpendicular axes, say X and Y axes. To the outside end of the threaded shaft 6, a handle 7 is attached for turning the shaft 6 clockwise or counterclockwise.

Figure 2:
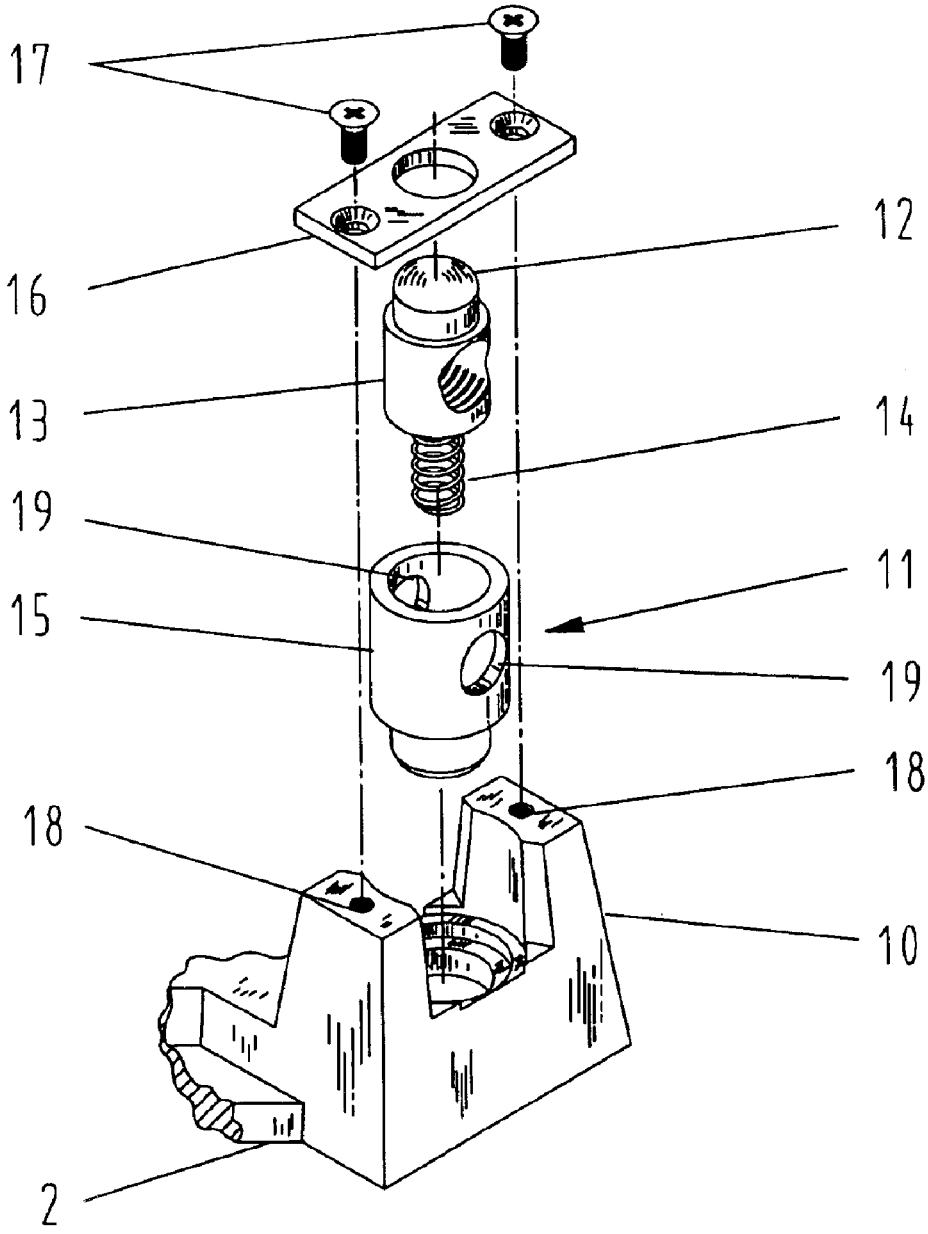
FIG. 2 is a perspective exploded view of the quick release mechanism mounted on the bottom-plate.

Referring to FIG. 1 and FIG. 2, quick release mechanism 11 with quick acting button 12 is built into ear 10. Instead of moving slowly pitch by pitch by turning the threaded shaft 6, the right-angle head 5 can be moved forward or backward quickly with handle 7 by pressing the quick acting button 12 to release the engagement of the threaded shaft 6 with the half-threaded nut 13. FIG. 2 shows the internal construction of the quick release mechanism 11 in detail. It comprises the quick acting button 12 with half-threaded nut 13, helical spring 14, sleeve 15, cover plate 16 and two screws 17. Quick acting button 12 is actually part of the half-threaded nut 13 which is threaded on the lower surface of the hole for feeding the threaded shaft 6. It is inserted into the center of the sleeve 15 with helical spring 14 in between. Two holes 19 just big enough to feed threaded shaft 6 freely are equipped on both sides of the sleeve 15. Sleeve 15 is inserted onto a recess area at the bottom of ear 10 so that it is free to rotate about its vertical axis. Quick acting button 12, half-threaded nut 13, helical spring 14 and sleeve 15 are retained in position by cover plate 16 and two screws 17 which are screwed into holes 18 on the top surface of ear 10. Threaded shaft 6 is fed through holes 19 and half-threaded nut 13. In normal position, threaded shaft 6 is engaged with the thread inside the hole of half-threaded nut 13. When the quick acting button 12 is pressed, the thread of half-threaded nut 13 is disengaged from threaded shaft 6 so that shaft 6 is free to slide inside nut 13, hence the floating right-angle head 5 is free to slide over the surface of the bottom-plate 2 for quick and easy clamping and releasing of the workpieces.

Figure 3:
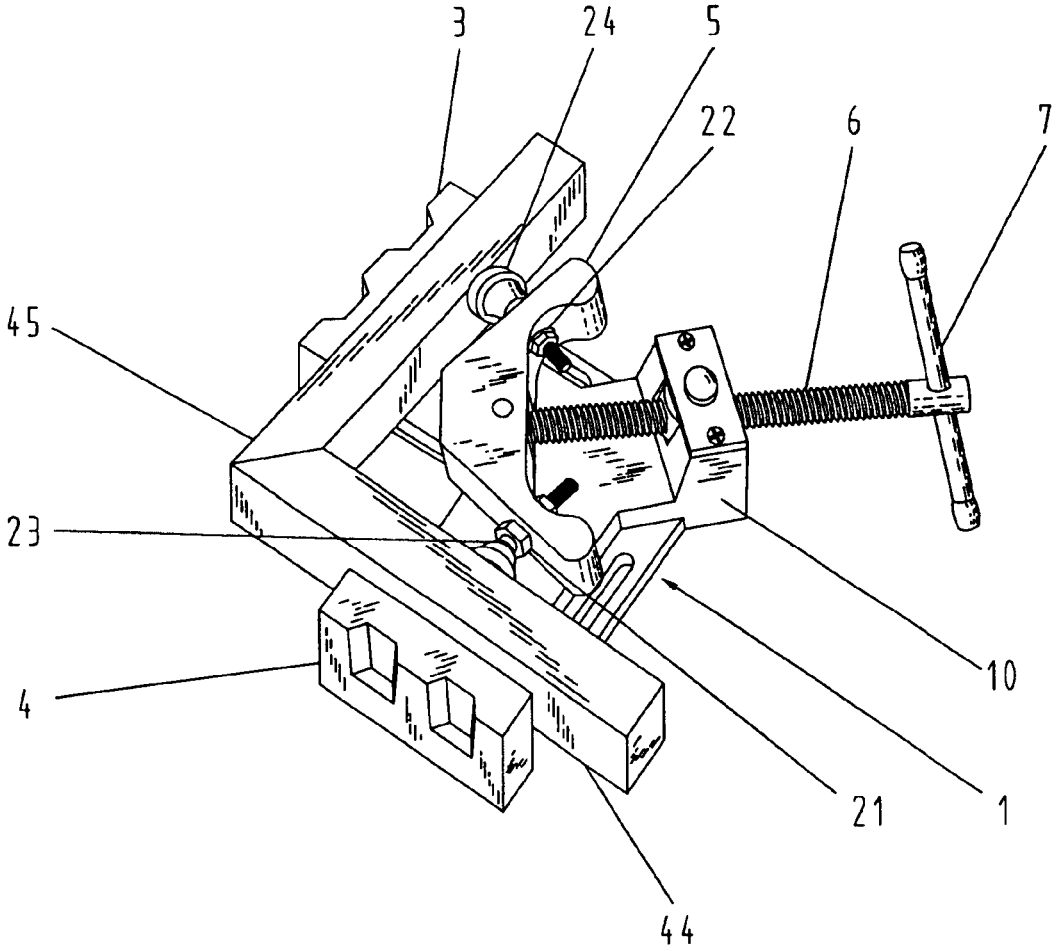
FIG. 3 is a perspective view of the angle clamp with leveling pads attached to the floating right-angle head clamping workpieces along X and Y directions.

FIG. 3 shows two workpieces 44 and 45 clamped in place along the X and Y axes. Two tooling holes 21 and 22 are equipped in the floating right-angle head 5, one on each clamping surface. Leveling pads 23 and 24 are inserted to the tooling holes 21 and 22 respectively and locked in position by nuts. With the leveling pads 23 and 24 in place, clearance between the workpieces and the floating right-angle head 5 is provided for increased welding access. The screw and nut design of the leveling pads 23 and 24 enables the adjustment for the required clearance.

Figure 4:
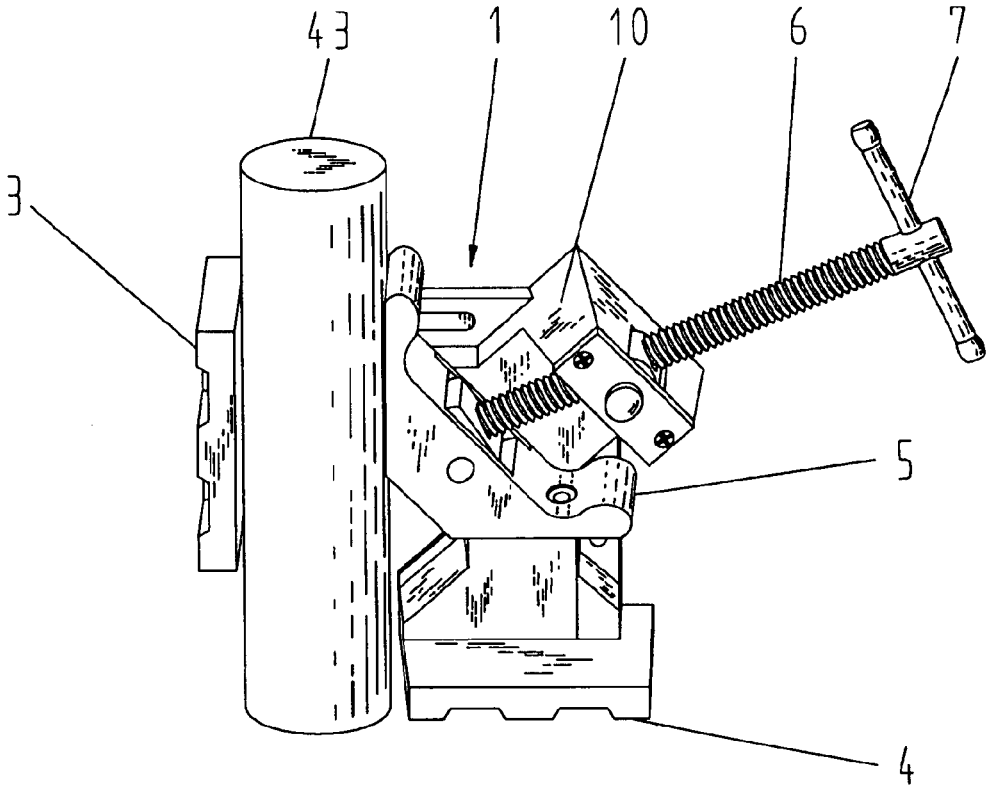
FIG. 4 is a perspective view of the angle clamp resting vertically on a work bench holding a cylindrical workpiece at the upright position.

With reference to FIG. 3 and FIG. 4, the outside surfaces of side-plates 3 and 4 are machined flat and square. Hence the angle clamp can be laid vertically with either the outside surface of side-plates 3 or the outside surface of side-plate 4 rest on the work desk to clamp a workpiece perpendicular to the surface of a work desk without the aid of other fixture or device. FIG. 4 shows the angle clamp 1 resting vertically with the outside surface of side-plate 4 on a work desk. The floating right-angle head 5 is clamping a cylindrical workpiece 43 to the inside surface of the side-plate 3 but vertically to the surface of the work desk.

Figure 5:
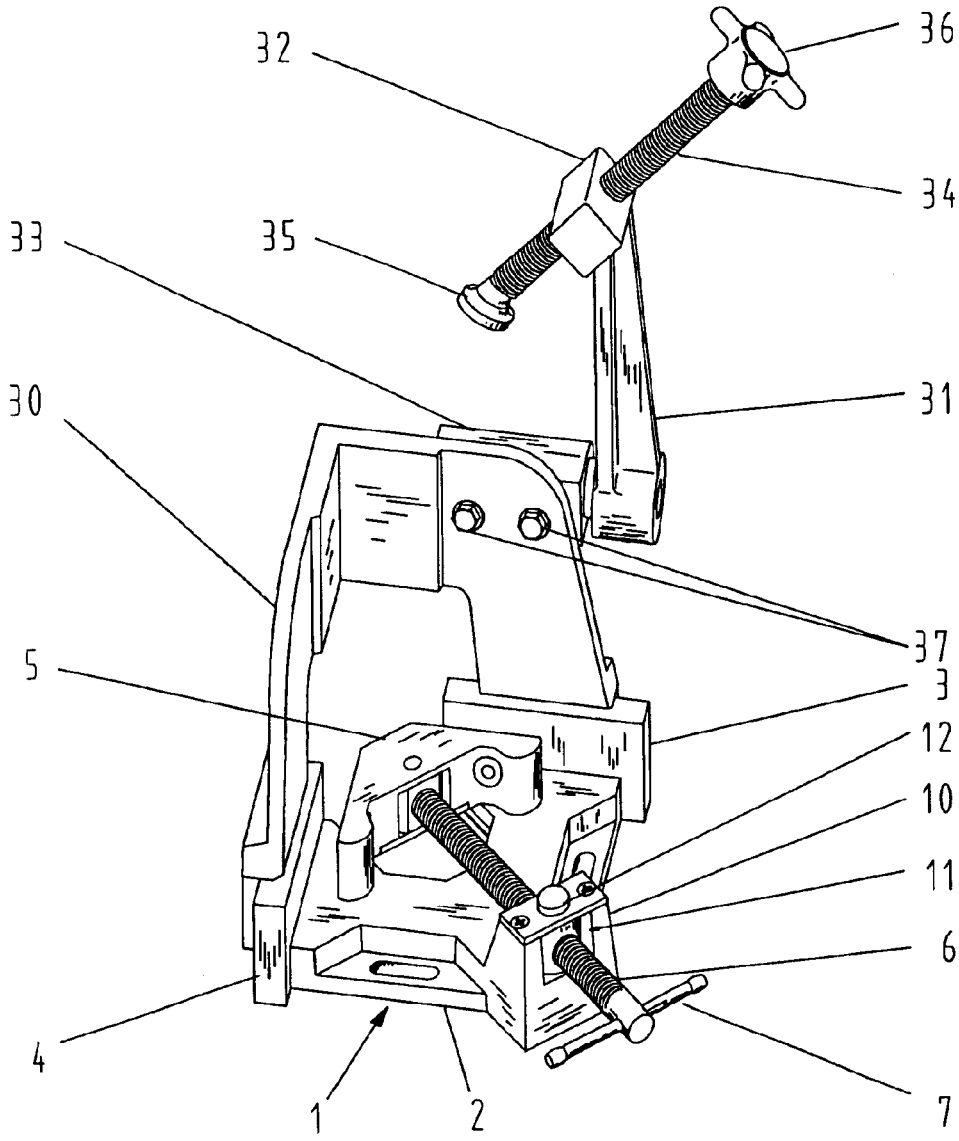
FIG. 5 is a perspective view of the angle clamp with the Z-axis attachment's swing away clamping arm in the open position.
Figure 6:
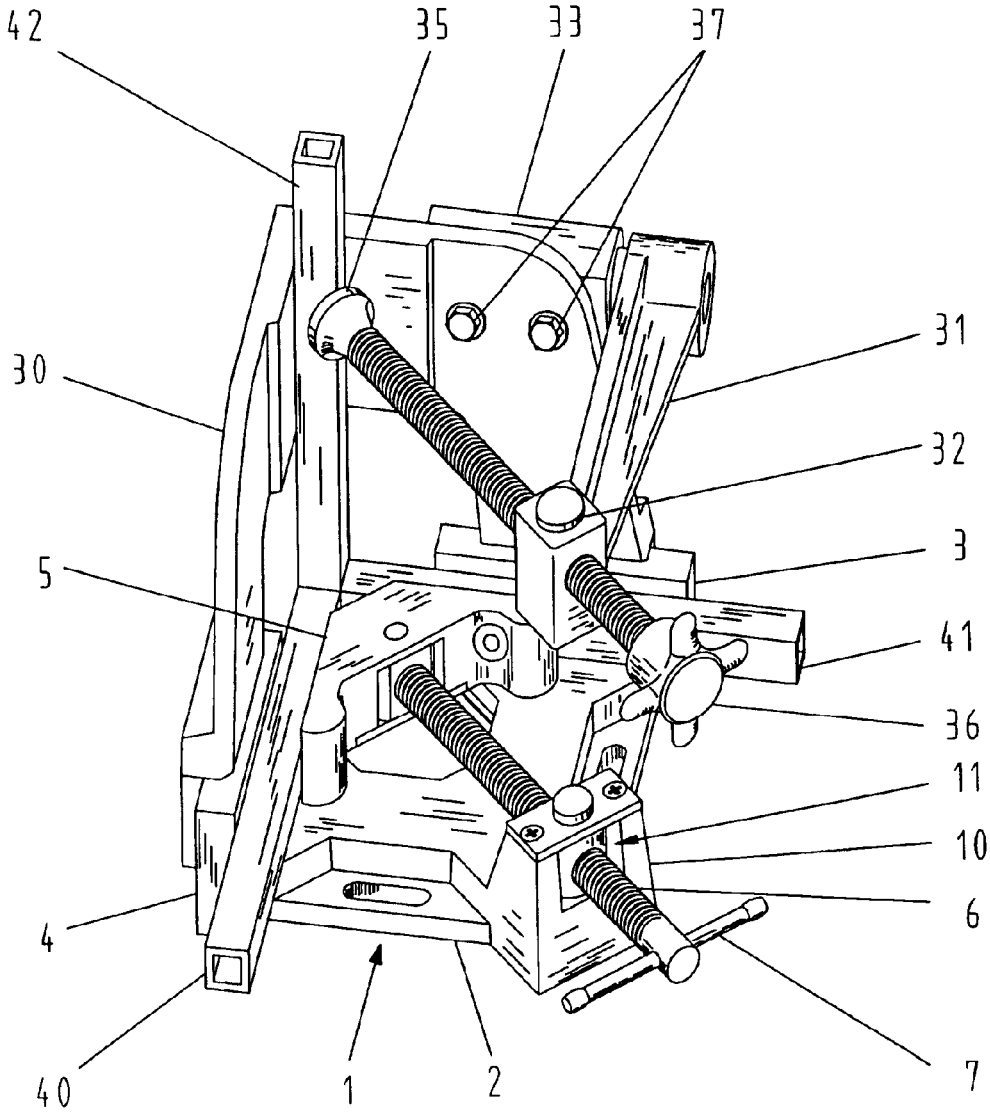
FIG. 6 is a perspective view of the angle clamp with the Z-axis attachment clamping workpieces along X, Y and Z directions.

Referring to FIG. 5 and FIG. 6, the Z-axis attachment comprises a right-angle metal plate 30, a clamping arm 31 with quick release mechanism 32, a mounting block 33 and a threaded shaft 34 with clamping pad 35 and turning knob 36. The right-angle metal plate 30 is mounted by screws to the two side-plates 3 and 4 and acts as an extension of the side-plates 3 and 4. The inside surfaces of the metal plate 30 is machined square and flat and made to be align with the inside surfaces of side-plates 3 and 4 so that workpieces 40, 41 and 42 can be clamped at a three dimensional mutually perpendicular relationship (along X, Y and Z axes). Two holes are provided on one side of the metal plate 30 to attach the clamping arm 31 through mounting block 33 with two screws 37. Clamping arm 31 is mounted to the mounting block 33 through a shaft inserted into mounting block 33 so that the clamping arm can be rotated about the axis of the shaft for an angle of approximately 135 degrees. This design enables the clamping arm 31 to be swung away from its clamping position to the open position for rapid and easy removal of the bulky finished workpiece. At the free end of the clamping arm 31, a quick release mechanism 32 is built into the rectangular shape block. This quick release mechanism 32, which is similar in design as the quick release mechanism 11 mounted in the ear 10 of the bottom-plate 2, comprises a quick acting button with half-threaded nut and a helical spring. Threaded shaft 34 is screwed into the half-threaded nut of the quick release mechanism 32. Clamping pad 35 is pivoted to the inside end of threaded shaft 34, and to the outside end a turning knob 36 is attached. This threaded shaft 34 is used to clamp a workpiece against the inside surfaces of the right-angle metal plate 30 along the Z-axis direction. FIG. 6 shows an example of clamping three workpieces along X, Y and Z axes at mutually perpendicular relationship. When the quick acting button is pressed, the half-threaded nut is disengaged from the threaded shaft 34 and the threaded shaft 34 can be pushed in or pulled out rapidly to adjust for workpieces of different thicknesses when clamping, or to remove the finished workpiece when releasing.

What I claim as my invention is:

1. An angle clamp with Z-axis attachment and quick acting buttons comprising:

three mutually perpendicular base plates including a square shape bottom-plate and two rectangular side-plates which are attached to two adjacent edges of said square shape bottom-plate so that both are perpendicular to said square shape bottom-plate and at right angle to each other;

a floating right-angle head attached to a first threaded shaft with a handle, said first threaded shaft being fed through a first quick release mechanism located in a protruded ear at the vertex of said square shape bottom-plate opposite to the other vertex where two said rectangular side-plates will meet if extended;

a Z-axis attachment including a right-angle metal plate, a mounting block and a clamping arm with a second quick release mechanism and a second threaded shaft with a turning knob and a clamping pad;

a quick acting button accessible from outside of each said quick release mechanism being used to control the locking and releasing action of each said quick release mechanism over each said threaded shaft.

2. The angle clamp with Z-axis attachment and quick acting buttons according to claim 1, wherein said square shape bottom-plate is equipped with two slotted holes along two adjacent edges other than the two edges attaching to two said rectangular side-plates so that said angle clamp assembly can be fixed to a work desk by screws.

3. The angle clamp with Z-axis attachment and quick acting buttons according to claim 1, wherein said floating right-angle head is free to swivel horizontally and to slide freely with said first threaded shaft on the flat surface of said square shape bottom-plate;

said first threaded shaft, when turned clockwise by said handle, will advance said floating right-angle head towards two said rectangular side-plates so that two workpieces can be clamped at right-angle to each other against the inside surfaces of two said rectangular side-plates;

said first threaded shaft, when turned counterclockwise by said handle, will retract said floating right-angle head away from two said rectangular side-plates so that said two clamped workpieces can be released.

4. The angle clamp with Z-axis attachment and quick acting buttons according to claim 1, wherein two tooling holes are provided on said floating right-angle head, one on each clamping surface, said tooling holes being internally threaded.

5. The angle clamp with Z-axis attachment and quick acting buttons according to claim 1, wherein two leveling pads, being threaded externally, may be inserted into said tooling holes on said floating right-angle head to adjust the clearance between workpieces and said floating right-angle head for better welding access, locking nuts may be added to lock said leveling pads in position.

6. The angle clamp with Z-axis attachment and quick acting buttons according to claim 1, wherein the outside surfaces of said two rectangular side-plates are machined flat and square so that said angle clamp assembly can be laid vertically with the outside surface of either one of said rectangular side-plates resting on a work desk to clamp a workpiece perpendicular to said work desk without the aid of other fixture or device.

7. The angle clamp with Z-axis attachment and quick acting buttons according to claim 1, wherein said Z-axis attachment comprising a right-angle metal plate, a swing away clamping arm with a second quick release mechanism, a mounting block and a second threaded shaft with clamping pad and turning knob;

said right-angle metal plate is mounted by screws to two said rectangular side-plates and act as an extension to two said rectangular side-plates;

the inside surfaces of said right-angle metal plate are machined square and flat and made to be in alignment with the inside surfaces of two said rectangular side-plates so that workpieces can be clamped at a three dimensional mutually perpendicular relationship;

said clamping arm is attached externally by screws through said mounting block to one side of said right-angle metal plate;

said second threaded shaft is fed through the free end of said clamping arm where said second quick release mechanisms is located.

8. The angle clamp with Z-axis attachment and quick acting buttons according to claim 1, wherein said clamping arm is attached to said mounting block through a shaft inserted to said mounting block so that said clamping arm can be rotated about the axis of said shaft for an angle of approximately 135 degrees;

said clamping arm can thus be swung away from a clamped workpiece for rapid and easy removal of said workpiece even though said workpiece may be very bulky after assembling work.

9. The angle clamp with Z-axis attachment and quick acting buttons according to claim 1, wherein said first quick release mechanism comprising:

a cylindrical shape first quick acting button;

a first half-threaded nut attached to the internal flat surface of said first quick acting button, said first half-threaded nut including a first half threaded hole with its axis at right angle to the axis of said first quick acting button, said first half threaded hole being threaded internally on the half side which is opposite to the side closer to said first quick acting button;

a first helical spring is placed and partially compressed between said first half-threaded nut and the inside wall of a sleeve which holds said first quick release mechanism;

said sleeve is located at one of the vertex of said square bottom-plate;

said second quick release mechanism comprising:

a cylindrical shape second quick acting button;

a second half-threaded nut attached to the internal flat surface of said second quick acting button, said second half-threaded nut including a second half threaded hole with its axis at right angle to the axis of said second quick acting button, said second half-threaded hole being threaded internally on the half side which is opposite to the side closer to said second quick acting button;

a second helical spring is placed and partially compressed between said second half-threaded nut and the inside wall of a cavity which holds said second quick release mechanism;

said cavity is located at the free end of said clamping arm of said Z-axis attachment.

* * * * *